United States Patent [19]

Goodley et al.

[11] Patent Number: 4,960,991

[45] Date of Patent: Oct. 2, 1990

[54] MULTIMODE IONIZATION SOURCE

[75] Inventors: Paul C. Goodley, Cupertino; Stuart C. Hansen, Palo Alto, both of Calif.

[73] Assignee: Hewlett-Packard Company, Palo Alto, Calif.

[21] Appl. No.: 422,936

[22] Filed: Oct. 17, 1989

[51] Int. Cl.[5] ..... H01J 49/10

[52] U.S. Cl. ..... 250/281; 250/282; 250/288; 250/289

[58] Field of Search ..... 250/281, 282, 288, 288 A, 250/289; 950/423 R, 422; 73/864.81, 863.11

[56] References Cited

U.S. PATENT DOCUMENTS

| | | | |
|---|---|---|---|
| 4,647,772 | 3/1987 | Lewis et al. | 250/281 |
| 4,814,612 | 3/1989 | Vestal et al. | 250/288 |
| 4,851,700 | 7/1989 | Goodley | 250/281 |

*Primary Examiner*—Jack I. Berman

*Assistant Examiner*—Kiet T. Nguyen

[57] ABSTRACT

A multimode ionization source includes a resistive filament aligned with an exit cone orifice. The filament generates electrons that bombard molecules near the orifice. In electron impact mode, a pressure regulator selects a low pressure within an ionization chamber and gaseous analyte is injected through a gas inlet and ionized by electron bombardment. In chemical ionization mode, an intermediate pressure of reagent gas established; electrons ionize the reagent gas. Gaseous analyte is introduced is ionized by the reagent gas through chemical interaction. In thermospray mode, a high pressure is established and heated liquid analyte is introduced into the chamber as a spray which is ionized by ion evaporation; in a thermospray/chemical ionization submode, filament activation supplements ion evaporation. Ions produced in all modes can be directed to a mass analyzer for analysis.

14 Claims, 3 Drawing Sheets

MULTIMODE IONIZATION SOURCE

BACKGROUND OF THE INVENTION

The present invention relates to analytical chemistry and, more particularly, to ion sources such as those used in chromatograph-spectrometer interfaces. A major objective of the present invention is to provide for alternative thermospray ionization, chemical ionization, and electron impact ionization modes in a single ion source without requiring time-consuming source exchanges.

Analytical chemistry has greatly advanced our ability to understand and protect life by characterizing its constituents and the disease-causing entities that threaten it. These ends have been facilitated by combining chromatographic techniques, which permit the separation of analyte components, and mass spectrometry, which aids in the identification and quantification of components so separated.

Mass spectrometry involves the separation of ions according to their mass-to-charge ratios by a mass filter. A suitable detector, such as a Faraday collector or an electron multiplier, is used to quantify incident ions of the mass-to-charge ratio selected by the mass filter. Generally, the analyte output from a chromatography system is not in the ionized vapor form required for the mass filter. Therefore, the interface between a chromatography system and a mass spectrometer generally includes an ion source which ionizes analyte-bearing gas or fluid output from the chromatography system before the analyte is introduced into the mass spectrometer filter.

Electron impact ionization, chemical ionization, and thermospray ionization are three well-established approaches used in ion sources for chromatograph/spectrometer interfaces. Each approach has its own set of hardware requirements and conditions. The different approaches vary in effectiveness depending on the analyte to be analyzed.

In a typical electron impact ionization source, analyte molecules are introduced in gaseous form into an ionization chamber. A resistive filament disposed near the point of analyte introduction generates high-energy free electrons which bombard the analyte gas molecules. The electrons can be captured by the gaseous analyte or can cause bound electrons to break loose from the analyte molecules, imparting a charge in either case. The pressure within the ionization chamber is kept very low (around $10^{-6}$ to $10^{-4}$ torr) to minimize neutralizing, or de-ionizing, collisions between the ions and other molecules or the apparatus walls. Ions can proceed down a path toward a mass filter or analyzer. The ions can be confined and focused by electromagnetic or electrostatic fields along the ion path through the mass filter or analyzer to the detector.

Chemical ionization as applied to a gaseous analyte is similar to electron impact ionization in that a filament is typically used to generate free electrons that produce ions. However, the primary mechanism by which the molecules of interest are ionized is not direct bombardment. Instead, an intermediary reagent gas is introduced into the chamber. The reagent gas is ionized by the electron bombardment. The analyte gas is then introduced, and is ionized through a chemical reaction with the reagent gaseous ions. Since chemical ionization relies on intermolecular activity for ionization, a sufficiently high density of molecules within the chamber is required to ensure that the desired molecular collisions occur. Therefore, the pressure required for chemical ionization is much greater than that used in electron impact approaches, although generally less than that used in thermospray ionization.

Electron impact and chemical ionization approaches are best suited for gaseous analytes. Such analytes can be provided by gas chromatography systems or by thermally vaporizing the outputs from liquid chromatography systems. However, some molecular products from liquid chromatography disassociate or otherwise fail to remain intact upon vaporization. Accordingly, thermospray ionization permits ionization of an analyte-bearing fluid without requiring thermal vaporization of the analyte.

In a typical thermospray set-up, analyte-bearing liquid eluting from a liquid chromatograph is heated as it flows through a capillary inlet tube into an ionization chamber. The heat vaporizes some but not all of the liquid, primarily carrier fluid or solvent. The vapor forces the analyte into the ionization chamber in the form of a heated spray of droplets of vapor. Evaporation causes spray droplets to shrink.

Uneven distributions of charge result in net charges on some fragment droplets. As these fragment droplets continue to shrink, the net charge can bind to an analyte molecule of interest. The charged molecule can be ejected from the fragment droplet once electric repulsion exceeds the surface tension forces of the droplet. This process is referred to as "ion evaporation". Typically, the ionization chamber for a thermospray apparatus has an ion exit with an axis orthogonal to the axis of the inlet. Pressures within the ionization chamber are relatively high since liquid and vapor are being introduced.

In addition to the ion evaporation mode just described, the thermospray approach admits of a chemical ionization mode. In this mode, a filament is used to ionize evaporated solvent, which is believed to ionize the analyte through a chemical reactions. The filament is placed nearer to the ionization chamber inlet than to the outlet to maximize the number of carrier and solvent molecules available as chemical ionization agents.

Since different approaches are required to ionize different analyte types before their introduction to an ion analyzer, such as a mass spectrometer, it would be advantageous to employ a single ion source which could implement all three ionization approaches described above. Dismantling and modifying ion sources can consume many hours and can significantly reduce analysis throughput and increase analysis costs. Furthermore, subsequent analyses are delayed so that short-lived analytes can be lost before they can analyzed.

Single ion sources have been commercialized which ionize liquid analytes using the thermospray approach in both ion evaporation and chemical ionization modes. In addition, single ion sources are available which combine electron impact and chemical ionization approaches to ionizing gaseous analytes. Heretofore, no single ion source has provided for ionization of both liquid and gaseous analytes. For example, if a user wishes to ionize analytes by thermospray and electron impact, the ion source must be exchanged.

What is needed is a single-chamber ion source that can ionize both liquid and gaseous analytes. More specifically, a multimode source is desired which provides for thermospray, chemical, and electron impact ionization so that the downtime required when switching ion sources can be avoided.

SUMMARY OF THE INVENTION

In accordance with the present invention, a multimode ionization source comprises a thermospray apparatus and means for directing high-energy electrons toward the exit orifice of its ionization chamber. A projection segment is defined as the intersection of the ionization chamber and the projection of the exit cone orifice along its axis. When an electron source is placed within 1 centimeter (cm) of the projection segment, and electrons from the electron source are directed toward the projection segment, the multimode ionization source can ionize gaseous analytes by electron impact ionization. By ionizing a reagent gas intermediary, the multimode source can ionize gaseous analytes by chemical ionization. The novel positioning of the electron source does not decrease the effectiveness of the thermospray apparatus. The ionization source also provides for varying the pressure within the ionization chamber as required for respective modes: electron impact ionization, chemical ionization, and thermospray ionization.

In one realization of the present invention, a resistive filament is aligned with the orifice axis so that it directs electrons along the orifice axis toward the orifice itself. In another realization, the filament is placed so that electrons travel generally orthogonal to the axis so as to intersect it near the orifice.

The source inlet admits both liquid and gas analytes, and, accordingly, can include both a thermospray capillary tube with an appropriate vaporizer and a separate inlet or inlets suitable for the injection of vapor into the chamber. Inlet selection can be automated in conjunction with mode selection or can be performed manually. Once a desired mode is selected, an ion source controller can ensure that an appropriate chamber pressure is established and that the source inlet and heating elements operate as required by the selected mode.

The present invention differs from prior thermospray devices in the region to be flooded with electrons, and, correspondingly, the location of the resistive filament used to generate the electrons. The effectiveness of the disclosed arrangement has been verified empirically. By way of explanation only, an electron impact approach that directs the electrons toward the exit cone orifice generates ions close enough to the orifice that they can escape the chamber with minimal losses due to ion collisions with other particles and with chamber walls. Due to the difficulty of implementing electron impact ionization in a thermospray context, commercialized thermospray devices have not incorporated the pressure subsystems required to attain the low pressures needed for electron impact ionization.

The present invention provides a multimode ion source that obviates the chore of changing ion sources when chemical or electron impact ionization is to follow a thermospray ionization or vice versa, and thus saves considerable analysis time. These and other features and advantages provided by the present invention are apparent in the description below with reference to the following drawings.

BRIEF DESCRIPTION OF THE DRAWINGS

FIG. 2 represents a view orthogonal to that of FIG. 1.

DESCRIPTION OF THE PREFERRED EMBODIMENTS

Figure 1:
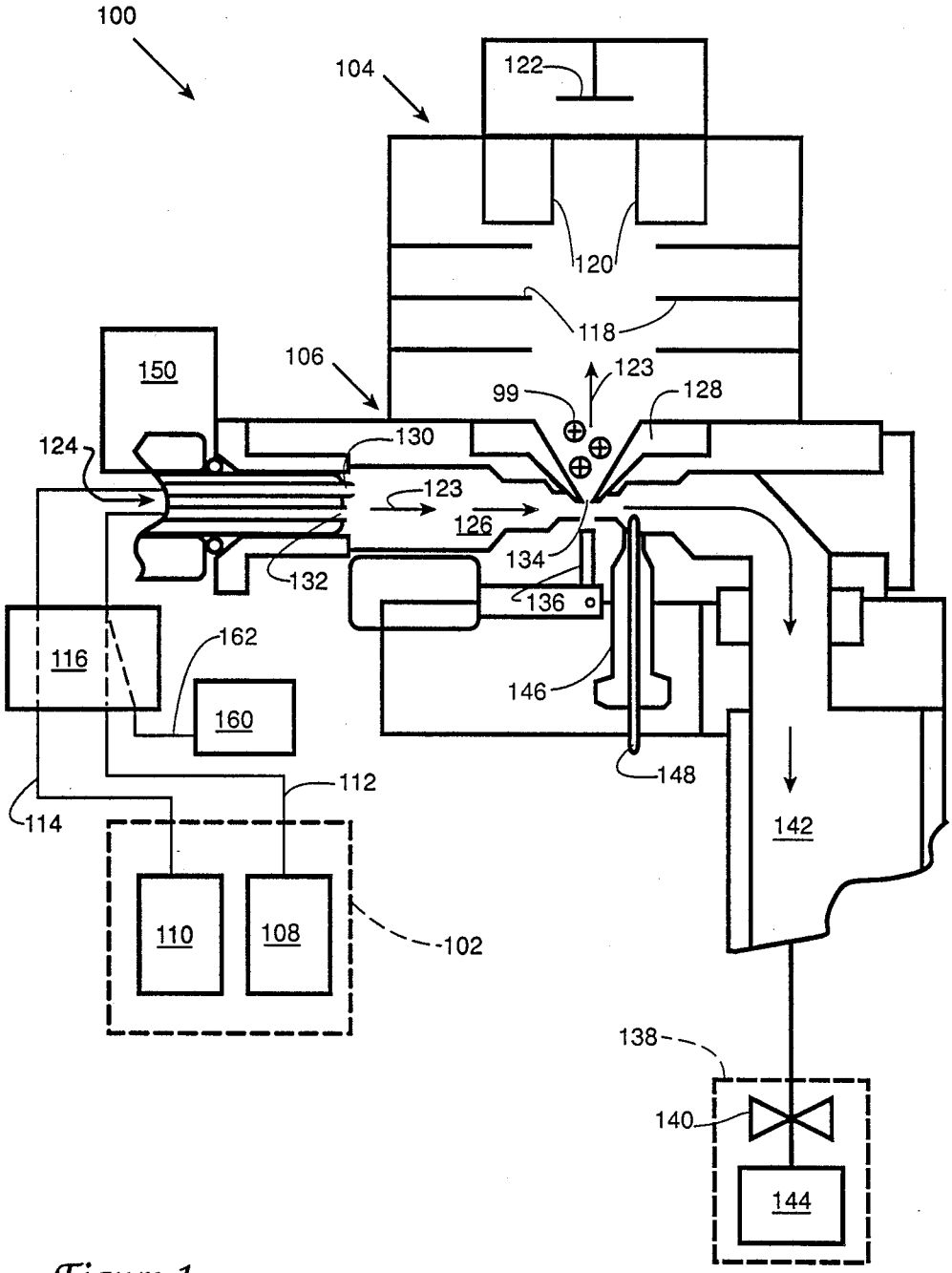
FIG. 1 is a schematic illustration of an analytical system in accordance with the present invention.

A chromatography/spectrometry system 100 includes a chromatograph section 102 and a mass spectrometer 104 with its interfacing ion source 106. Chromatograph section 102 includes a gas chromatography subsystem 108 and a liquid chromatography subsystem 110. Chromatography subsystems 108 and 110 communicate with ion source 106 via lines 112 and 114, respectively. Fluid flow through lines 112 and 114 is controlled via a valve assembly 116. Mass spectrometer 104 includes a collimating lens 118, a quadrupole mass filter 120, and a Faraday collector 122.

Ion source 106 defines an analyte path 123 from an inlet assembly 124, through an ionization chamber 126, and out an exit cone 128. Ions 99 are shown exiting cone 128. Inlet assembly 124 comprises a thermospray inlet 130 and a gas inlet 132. Exit cone 128 includes an orifice 134. In accordance with the present invention, a resistive filament 136 is positioned so that it directs electrons across chamber 126 and toward orifice 134. Note that filament 136 is much closer to exit cone 128 than it is to inlet assembly 124.

A pressure regulator 138 for ion source 106 includes a variable valve 140, an exhaust port 142, and a vacuum pump 144. A thermal regulator 146 includes a thermocouple 148 that protrudes into chamber 126. An ion source controller 150 coordinates the foregoing ion source components to effect the operations described below.

Figure 2:
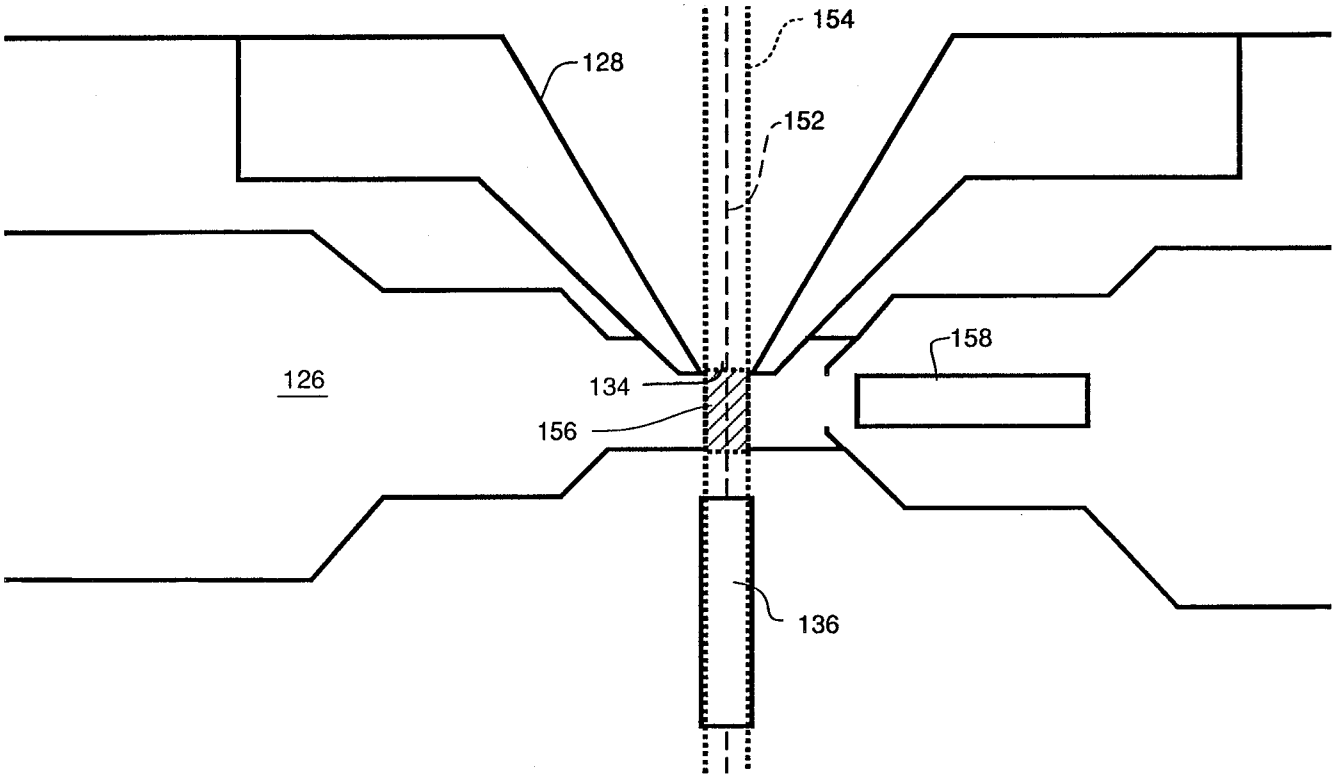
FIG. 2 is a schematic illustration of an ionization chamber showing a region to be flooded in the analytical system of FIG. 1.
Figure 3:
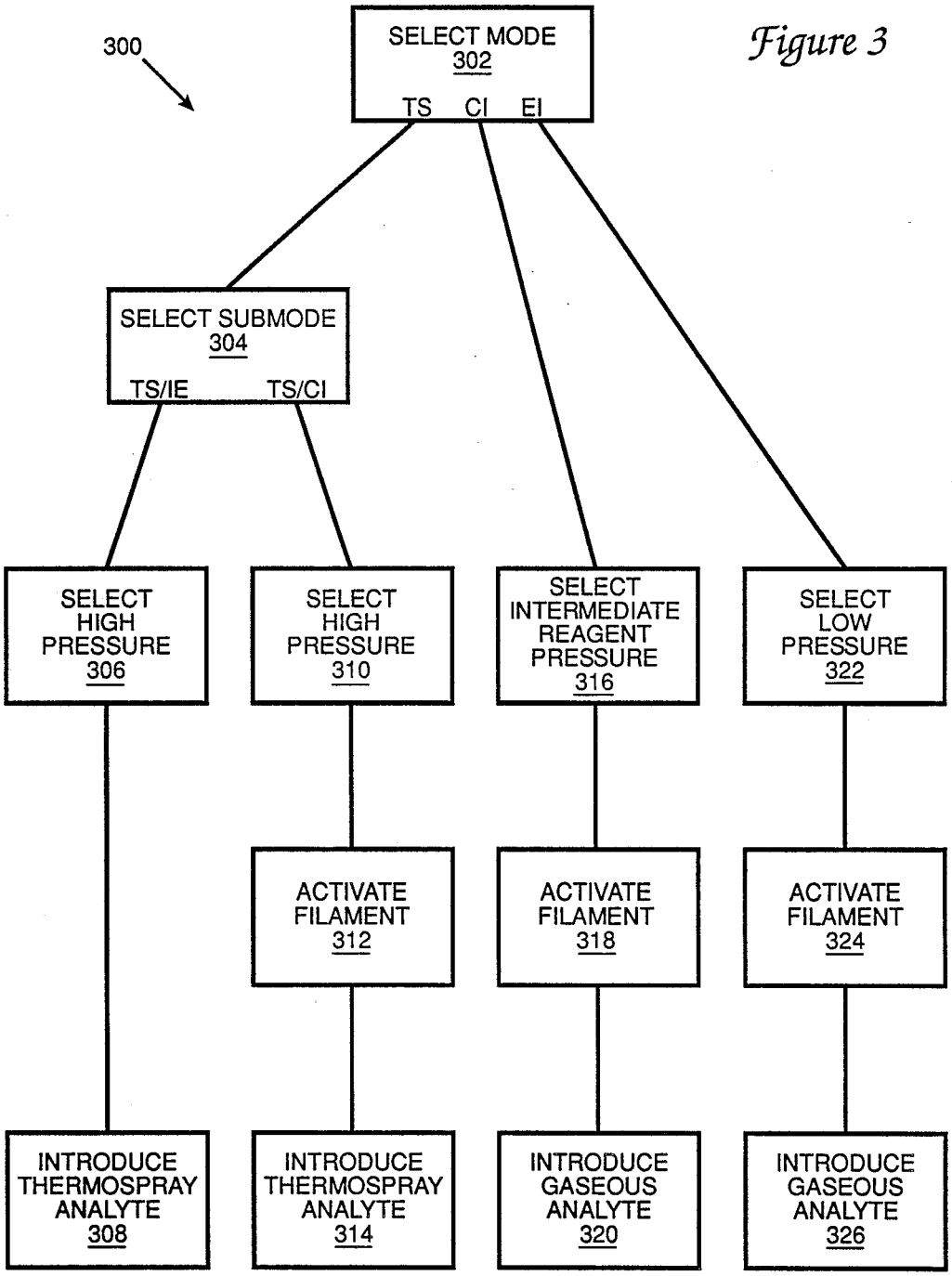
FIG. 3 is a flow chart of a method of the present invention which can be practiced using the analytical system of FIG. 1.

As shown in FIG. 2, exit cone orifice 134 has an axis 152 and a projection 154 along this axis. The intersection of projection 154 with chamber 126 defines a projection segment 156. Filament 136, when activated, floods projection segment 156 with high-energy electrons. These electrons can be used in an electron impact mode, in a chemical ionization mode, and in a chemical ionization submode of a thermospray mode. By way of explanation and not of limitation, it is believed that the illustrated configuration of filament 136 and orifice 134 minimizes the chances that a molecule ionized in electron impact mode will be neutralized by a collision prior to escaping chamber 126 through exit cone 128.

Ion source 106 includes a second filament 158 oriented orthogonally with respect to orifice axis 152 and the chamber axis (into the page of FIG. 2). When activated, filament 158 directs electrons toward projection segment 156. The electrons from filament 158 travel generally orthogonal to orifice axis 152, in contrast to those from filament 136 which travel generally along orifice axis 152. Filament 158 can be used instead of filament 136 or can be used in combination therewith to enhance ionization.

In accordance with the present invention, a method 300 for generating ions permits a mode selection, at 302, between three primary modes: thermospray (TS), chemical ionization (CI), and electron impact (EI). In the event thermospray ionization is selected, a further selection is made, at 304, between a thermospray/ion evaporation (TS/IE) submode and a thermospray/-chemical ionization (TS/CI) submode. In TS/IE submode, pressure regulator 138 selects, at 306, a suitable, relatively high pressure in ionization chamber 126 as is known in the art. Liquid analyte from liquid chromatography section 110 is introduced, at 308, into ionization chamber 126 via appropriately set valve assembly 116 and inlet nozzle 130. Inlet nozzle 130 includes a heater for the rapid heating and vaporization of solvent bearing the analyte of interest.

After TS/IE ionization, ions 99 enter spectrometer 104 via exit cone 128, where they are focused by lens 118 and filtered by quadrupole filter 120. The ions so selected by filter 120 are then detected by Faraday collector 122. These last steps, which are part of the operation of spectrometer 104, are common to the remaining submode and modes of method 300.

In TS/CI submode, pressure regulator 138 establishes, at 310, a suitable, relatively high pressure in ionization chamber 126. Filament 136 is activated, at 312. The order in which steps 310 and 312 are performed is a matter of convenience. Sample introduction, at 314, and the mass spectrometry steps are essentially the same as in TS/IE mode.

In the event that chemical ionization mode is selected, an intermediary reagent gas from source 160 is introduced into ionization chamber 126. At this point, valve assembly 116 is set so that line 162 from source 160 is coupled to gas inlet 132. An intermediate pressure is established, at 316, by introduction of the reagent gas. Ideally, to maximize the interaction between the ionized reagent and the analyte, 10 to 100 times more reagent gas than analyte should be present in the ionization chamber. To maintain desired concentrations, the reagent gas from source 160 is introduced continuously throughout the ionization process. Filament 136 is activated, at 318. After these steps, gaseous analyte from gas chromatography subsystem 108 is introduced, at 320, into the stream of reagent gas entering chamber 126. Valve assembly 116 is accordingly set to couple line 112 to gas inlet 132. The order in which steps 316 and 318 are performed is a matter of convenience.

In electron impact mode, a relatively low pressure is established, at 322. Filament 136 is activated, at 324. Gaseous analyte is introduced, at 326, into chamber 126, as in CI mode step 320. In either CI or EI mode, the ions produced are analyzed in essentially the same manner as those produced in thermospray mode.

Variations on the preferred chromatography/spectrometry system are provided by the present invention. The described ion source can be used in conjunction with other ionization approaches, including Penning discharge, plasma discharge and field desorption. The resistive filament need not be aligned with the orifice of the exit cone. The projection segment can extend one centimeter from the orifice, either into the chamber or away from the chamber. The filament, or alternatively, another electron source, can be positioned anywhere within 1 cm of the projection segment provided sufficient electrons are available to flood the projection segment. The filament can be arranged to direct electrons toward the exit orifice or toward any point in the projection segment. For example, the filament can be disposed to direct electrons across the orifice and orthogonal to the orifice axis. Alternatively, the filament can be disposed on the spectrometer side of exit cone 128 so that electrons are directed toward projection segment 156 and toward orifice 134. The source of bombarding electrons need not be a filament. In addition, multiple filaments or electron sources can be used, provided at least one source floods the projection segment of the exit orifice.

It should be noted that an electron source can direct electrons toward a space, e.g., a projection segment, without directing all or even most generated electrons toward that space. The criterion of interest herein is whether a sufficient flow of high energy electrons is available within that space to cause a useful level of ionization.

The inlet means can take different forms. For example, multiple gas inlets or multiple liquid inlets can be used. Furthermore, a single inlet can be used for introducing both liquid and gaseous analytes. In this case, a multiplexing valve scheme can be used. Even in a multiple inlet arrangement, provision can be made for vaporizing the output of the liquid chromatograph and routing the vapor to the gas inlet rather than the thermospray nozzle. The inlet means can also include inlet separation means such as porous tubes and membranes.

In addition to conventional gas and liquid chromatographs, analytes can include effluent from ion chromatographs and other sources of mobile molecules. ("Molecules", as used herein, includes atoms, ions, and multi-atom molecules.) In alternative embodiments, the mass analyzer includes any means for mass analysis, such as timeof-flight analyzers and magnetic deflectors. Furthermore, the detector function can be provided using other detector types, such as electron multipliers, Daly detectors, zero background detectors, and p-n junctions.

The ion source can be used for purposes other than a chromatograph/spectrometer interface. These and other variations upon and modifications to the described embodiments are provided for by the present invention, the scope of which is limited only by the following claims:

What is claimed is:

1. A system comprising:

chamber means for confining an analyte-bearing fluid about a predetermined path;

inlet means for admitting analyte into said chamber, said inlet means providing for the introduction of analyte along said path, said analyte being in a form included in the set consisting of thermospray form and vapor form;

outlet means for permitting ions traveling along said path to exit said chamber, said outlet means having an orifice permitting fluid communication between said chamber means and an ion analyzer, said orifice having an orifice axis, said orifice also having a projection along said axis, said projection having a projection segment within one centimeter of said orifice, said outlet means being coupled to said chamber to permit ions to exit said chamber and enter said ion analyzer;

pressure regulation means for regulating pressure within said chamber;

electron source means for generating free electrons within one centimeter of said projection segment and directing them toward said projection segment; and a controller for determining the operating mode of said system, said controller alternatively providing for a thermospray ionization mode and an electron impact ionization mode, said controller being coupled to said inlet means so as to determine when analyte-bearing fluid is injected into said chamber in thermospray form and when analyte-bearing fluid is injected into said chamber in gaseous form, said controller being coupled to said pressure regulation means, said controller when providing for said thermospray ionization mode, causing said pressure regulation means to maintain a relatively high pressure in said chamber and causing said inlet means to introduce analyte-bearing fluid onto said path in thermospray form, and when providing for said electron impact ionization mode, causing said pressure regulation means to establish a relatively low pressure in said chamber and causing said inlet means to introduce analyte-bearing fluid onto said path in gaseous form.

2. The system of claim 1 wherein said electrons are directed toward said orifice.

3. The system of claim 1 wherein said electrons are directed toward said orifice axis.

4. The system of claim 1 wherein said electron source means includes a filament arranged so as to direct electrons toward said orifice axis.

5. The system of claim 1 wherein said electron source means includes a resistive filament for generating free electrons, said filament being located within one centimeter of said orifice axis.

6. The system of claim 5 wherein said filament is on said orifice axis.

7. A method of ionizing an analyte-bearing fluid moving through an inlet means of an ionization chamber into said chamber and exiting said chamber through an orifice of an outlet means, said method comprising the following steps:

(1) selecting between a thermospray ionization mode and an electron impact ionization mode for ionizing an analyte-bearing fluid;

(2) if said thermospray ionization mode is selected, continuing with steps 4*a* and 4*b*, otherwise continuing with steps 3*a* to 3*c;*

(3*a*) selecting a relatively low pressure in said ionization chamber;

(3*b*) generating free electrons within one centimeter of a projection segment, said projection segment being the intersection of said chamber and a projection of said orifice along its axis, said projection segment being disposed within one centimeter of said orifice; and (3*c*) introducing said analyte-bearing fluid in vapor form into said chamber through said inlet means; whereby said free electrons bombard said analyte-bearing fluid so that ions are formed sufficiently close to said orifice that ions so produced can diffuse through said orifice and out of said chamber;

(4*a*) selecting a relatively high pressure in said ionization chamber; and (4*b*) introducing analyte-bearing fluid in thermospray for into said chamber so that ions so formed can exit said chamber through said orifice.

8. The method of claim 7 further characterized in that step 3*b* involves directing said beam of electrons toward said orifice.

9. The method of claim 7 further characterized in that step 3*b* involves directing said beam of electrons toward said orifice axis.

10. A system comprising:

separation means for separating analytes containing components of interest, in the alternative, separated components in liquid form and in gaseous form;

an ion analyzer for analyzing ionized analytes; and an ion source including:

a chamber;

inlet means for admitting analytes from said separation means into said chamber, said inlet means being coupled to said separation means and said chamber;

orifice means for permitting ions in said chamber to exit said chamber and enter said ion analyzer, said orifice means being coupled to said chamber means and said ion analyzer, said orifice means having an orifice axis, said orifice having a projection along its axis, said projection having a projection segment, said projection segment being the intersection of said projection and said chamber, said projection segment being disposed within one centimeter of said orifice;

a pressure regulator for regulating pressure within said chamber;

electron source means for generating free electrons within one centimeter of said orifice and directing them toward said projection segment; and a controller for setting the operating mode of said system, said controller alternatively providing for a thermospray ionization mode and an electron impact ionization mode, said controller being coupled to said inlet means, said pressure regulator and said electron source means, said controller when said thermospray ionization mode is selected, causing said inlet means to admit liquid analyte into said chamber and causing said pressure regulator to establish a relatively high pressure within said chamber, when said electron impact ionization mode is selected, causing said inlet means to admit gaseous analyte into said chamber and causing said pressure regulator to establish a relatively low pressure within said chamber, said controller also activating said electron source means so as to bombard said gaseous analyte.

11. The system of claim 10 wherein said separation means includes a liquid chromatograph and a gas chromatograph.

12. The system of claim 11 wherein said inlet means includes a thermospray nozzle and a separate gas inlet, said inlet means including routing means for coupling said thermospray nozzle to said liquid chromatograph and said gas inlet to said gas chromatograph.

13. The system of claim 10 further comprising a reagent gas source coupled to said inlet means so that reagent gas can be admitted into said chamber, said controller providing for an alternative chemical ionization mode, said controller when said chemical ionization mode is selected, causing said inlet means to admit reagent gas into said chamber and activating said electron source so as to ionize said reagent gas, said controller causing said pressure regulator to establish a relatively intermediate pressure within said chamber, said controller causing said inlet means to admit gaseous analyte into said chamber;

whereby, said analyte is ionized through chemical interaction with ionized reagent gas.

14. A system comprising:

separation means for separating analytes containing components of interest, in the alternative, separated components in liquid form and in gaseous form;

an ion analyzer for analyzing ionized analytes; and an ion source including:

a chamber;

inlet means for admitting analytes from said separation means into said chamber, said inlet means being coupled to said separation means and said chamber;

orifice means for permitting ions in said chamber to exit said chamber and enter said ion analyzer, said orifice means being coupled to said chamber means and said ion analyzer, said orifice means having an orifice axis, said orifice having a projection along its axis, said projection having a projection segment, said projection segment being the intersection of said projection and said chamber, said projection segment being disposed within one centimeter of said orifice;

a pressure regulator for regulating pressure within said chamber;

electron source means for generating free electrons within one centimeter of said orifice and directing them toward said projection segment; and a controller for setting the operating mode of said system, said controller alternatively providing for a thermospray ionization mode and an chemical ionization mode, said controller being coupled to said inlet means, said pressure regulator and said electron source means, said controller when said thermospray ionization mode is selected, causing said inlet means to admit liquid analyte into said chamber and causing said pressure regulator to establish a relatively high pressure within said chamber, and when said chemical ionization mode is selected, causing said inlet means to admit reagent gas into said chamber and activating said electron source so as to ionize said reagent gas, said controller causing said pressure regulator to establish a relatively intermediate pressure within said chamber, said controller causing said inlet means to admit gaseous analyte into said chamber.

* * * * *